US008850738B2

(12) United States Patent
Silver

(10) Patent No.: US 8,850,738 B2
(45) Date of Patent: Oct. 7, 2014

(54) COMBINATION SAFETY ROUND AND MULTI-TOOL

(71) Applicant: Safe Tech, Inc., Knoxville, TN (US)

(72) Inventor: H. Steven Silver, Knoxville, TN (US)

(73) Assignee: Safe Tech, Inc., Knoxville, TN (US)

( * ) Notice: Subject to any disclaimer, the term of this patent is extended or adjusted under 35 U.S.C. 154(b) by 0 days.

(21) Appl. No.: 14/176,368

(22) Filed: Feb. 10, 2014

(65) Prior Publication Data

US 2014/0237877 A1 Aug. 28, 2014

Related U.S. Application Data

(60) Provisional application No. 61/768,114, filed on Feb. 22, 2013.

(51) Int. Cl.
*F41C 27/00* (2006.01)
*F41A 9/53* (2006.01)
*F41A 17/00* (2006.01)

(52) U.S. Cl.
CPC ..... *F41A 17/00* (2013.01); *F41C 27/00* (2013.01)
USPC ..... 42/108; 42/1.05

(58) Field of Classification Search
USPC ..... 42/108, 106, 70.11, 70.01, 90, 1.01, 42/1.05; 102/502, 442
See application file for complete search history.

(56) References Cited

U.S. PATENT DOCUMENTS

| | | | | |
|---|---|---|---|---|
| 4,819,289 | A * | 4/1989 | Gibbs | 7/118 |
| 4,835,894 | A * | 6/1989 | Libassi | 42/70.11 |
| 4,965,952 | A * | 10/1990 | Miller et al. | 42/1.05 |
| 5,097,613 | A * | 3/1992 | Miller et al. | 42/70.01 |
| 5,416,940 | A * | 5/1995 | Bandera | 7/118 |
| 6,250,008 | B1 * | 6/2001 | Silver | 42/70.01 |
| 6,470,615 | B1 * | 10/2002 | Peterken | 42/70.01 |
| 6,785,994 | B2 * | 9/2004 | Christiansen | 42/1.05 |
| 6,904,634 | B2 * | 6/2005 | Smith | 7/128 |
| 7,637,049 | B1 * | 12/2009 | Samson et al. | 42/108 |
| 2009/0199345 | A1 * | 8/2009 | Morgan | 7/118 |
| 2011/0283588 | A1 * | 11/2011 | Samson et al. | 42/108 |

OTHER PUBLICATIONS

Del-Ton, Inc. AR-15 Chamber Safety Tool.(n.d.). del-ton.com. Retrieved Jun. 16, 2014, from http://www.del-ton.com/Chamber_Safety_Tool_p/tl1023-p.htm.*

* cited by examiner

*Primary Examiner* — Jonathan C Weber
(74) *Attorney, Agent, or Firm* — Luedeka Neely Group, PC

(57) ABSTRACT

A combination firearm safety round that is configured to have tool features compatible for performing maintenance on the firearm. The safety round includes a cylindrical body portion having a small diameter extension having a substantially flat distal end, such that the extension is suitable as a tool for field stripping and maintenance of the firearm.

2 Claims, 12 Drawing Sheets

COMBINATION SAFETY ROUND AND MULTI-TOOL

CROSS REFERENCE TO RELATED APPLICATION

This application claims priority to U.S. Provisional Application No. 61/768,114 filed Feb. 22, 2013, entitled COMBINATION SAFETY ROUND AND MULTI-TOOL, and incorporated by reference herein in its entirety.

FIELD

This disclosure relates to the field of firearm safety devices. More particularly, this disclosure relates to a firearm safety round that is configured to have integrated tool features compatible for performing maintenance on the firearm.

BACKGROUND

Firearm safety plugs are used to occupy the firing chamber of a weapon and provide a visual indication that the chamber is occupied by a safety round. The presence of the safety round in the chamber insures that live ammunition round cannot be in the firing chamber.

When it is desired to load live ammunition in to the firearm, the safety round is ejected from the firearm and a live round is chambered. The user keeps the safety round, such as in a pocket or ammunition pack for later use when it is desired to have a safety round in place.

Firearms typically require periodic maintenance. In the case of combat firearms, such maintenance must often be performed in the field. However, the carrying of tools and the like for maintaining the firearm can be inconvenient and account for unneeded additional weight.

Accordingly, what is needed is a firearm safety round that functions as a safety round while also providing tools for periodic maintenance of firearms and that is lightweight, portable and easily usable.

SUMMARY

The above and other needs are met by a firearm safety device configured to function as a safety round for a firearm having a firing chamber that includes bore and to be received within the firing chamber in the manner of a round of ammunition positioned or chambered for firing.

In one aspect, the safety round includes a cylindrical body portion having a first portion having a diameter and configured for being chambered into the firing chamber of the firearm in the manner of a live ammunition round, and an extension extending distally from the first portion. The extension has a diameter which is substantially smaller diameter than the diameter of the first portion and having a substantially flat distal end. The small diameter of the extension and the flat end of the extension render the extension suitable as a tool for field stripping and maintenance of the firearm.

The safety round also includes a tab that extends outward away from the end of the body portion. The tab is sized and configured for extending out from the firing chamber when the first portion of the cylindrical body portion is chambered in the firearm and to be visible outside of the firearm in order to provide visual confirmation that the firing chamber is free of live ammunition.

The safety round also includes pin hingedly mounted to the tab for being pivotally moved between first and second positions. In the first position, the distal end of the pin extends outwardly from the tab. In the second position, distal end of the pin lies closely adjacent the tab. The pin is suitable for use as a tool for maintaining the firearm when pivoted to the first position.

BRIEF DESCRIPTION OF THE DRAWINGS

Further advantages of the invention are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
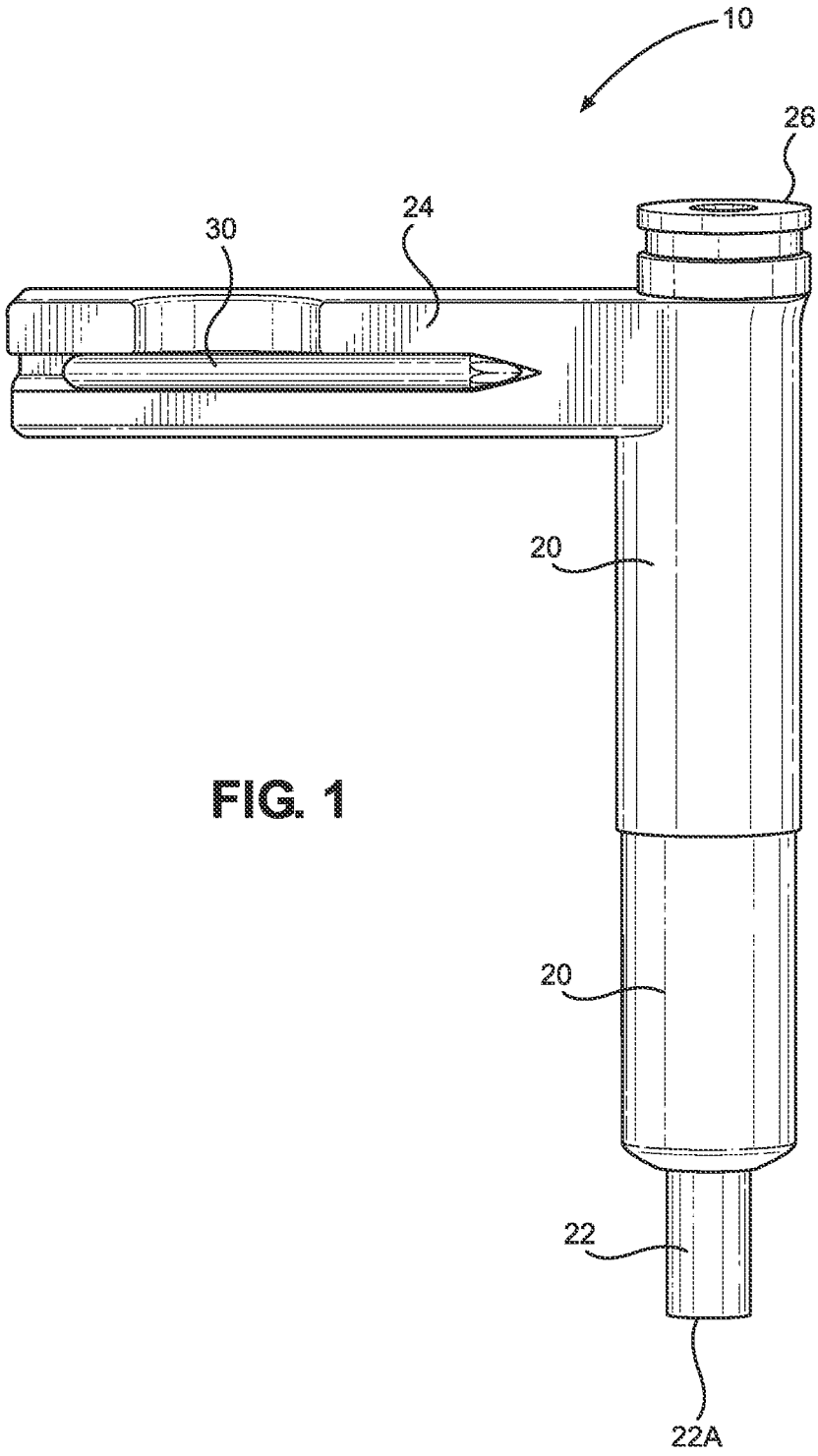
FIGS. 1-3 show a safety round according to the disclosure that incorporates tool structures.

With reference to the drawings, the disclosure relates to a firearm safety round 10 configured to have additional functionality beyond use as a firearm safety round. The round 10 incorporates tool structures that can be used in a variety of ways to maintain or otherwise work on the firearm, while maintaining the functionality of the safety round.

The round 10 as described herein is sized and configured to correspond to a 0.223 cartridge or 5.56×45 mm cartridge for use with an AR-15 style assault rifle or the like commonly used by military forces. However, it will be understood that the round 10 can be sized and configured to be compatible with firearms of a variety of configurations and cartridge sizes, and including cartridges or rounds for pistols and shotguns.

The round 10 is configured in one aspect to function as a safety round and is configured to be received within a firing chamber of a firearm in the manner a round of ammunition is positioned or chambered for firing. For example, the round 10 includes a cylindrical body 20 having a diameter that is slightly less than the diameter of the firing chamber for fitting in the chamber in the manner of a live ammunition round. The body 20 includes a smaller diameter front portion 22 that is proportioned for resting against a shouldered section of the firing chamber which opens into a rifled barrel of the fire arm. The cylindrical body 20 corresponds to a casing of live ammunition and the front portion 22 corresponds to a bullet.

A tab 24 extends from an upper portion of the body 20. The tab 24 is configured for extending outwardly from a closed firing chamber of the firearm to visually indicate that the firing chamber of the firearm is free of live ammunition. The body 20, front portion 22, and tab 24 may be individual components, but, are preferably formed together, as by injection or other plastic molding, so as to provide a one-piece structure. A rim member 26 is located at the end of the body 20 adjacent the tab 24. The rim member 26 is preferably made of metal and fixedly connected to the body 20. The rim member 26 is configured for being engaged by an extractor associated with the firing chamber of the firearm for ejecting the round 10 from the firearm. The rim member 26 may also include a detent 40 or other structure in the location of a primer for receiving the firing pin of the rifle to facilitate dry firing of the rifle if desired.

In addition to the foregoing structures which are provided for the purpose of providing a firearm safety plug, the round 10 also includes tool structures. The tool structures can be used in a variety of ways to maintain or otherwise work on the firearm, while maintaining the safety round functionality of the round 10. For example, the front portion 22 is configured to have a substantially smaller diameter than the body 20 so as to be dimensioned to be useful as a tool for field stripping and other maintenance of an AR-15 rifle. The distal end 22*a* of the front portion 22 is also desirably formed to be flat. In this regard, the reduced diameter and the flat end 22*a* of the front portion 22 enables the front portion 22 to be used as a push tool, such as for removal or disengagement of receiver pins of the rifle. The tab 24 can assist as a handle for pressing the front portion 22 against a pin or the like.

Figure 2:
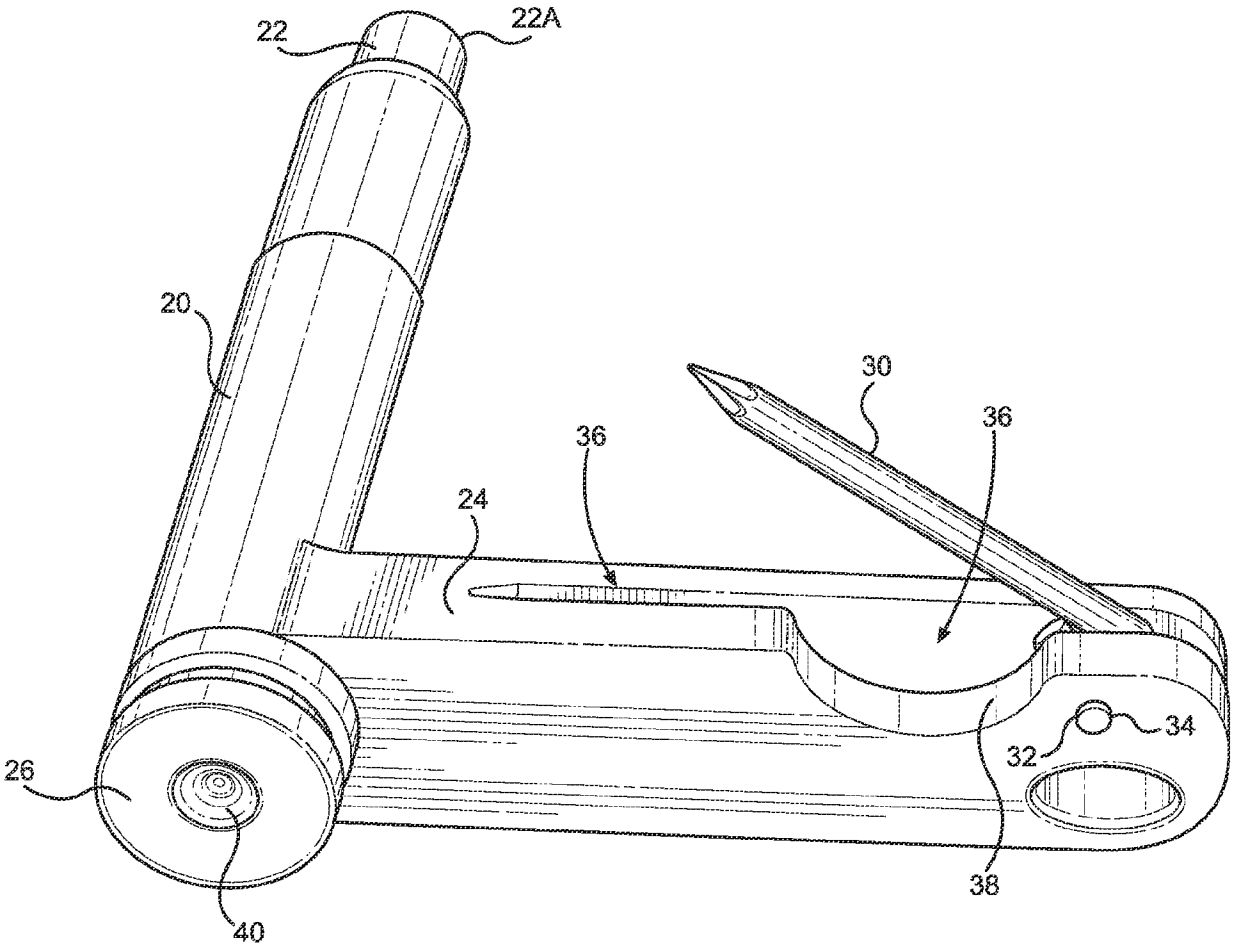
Figure 3:
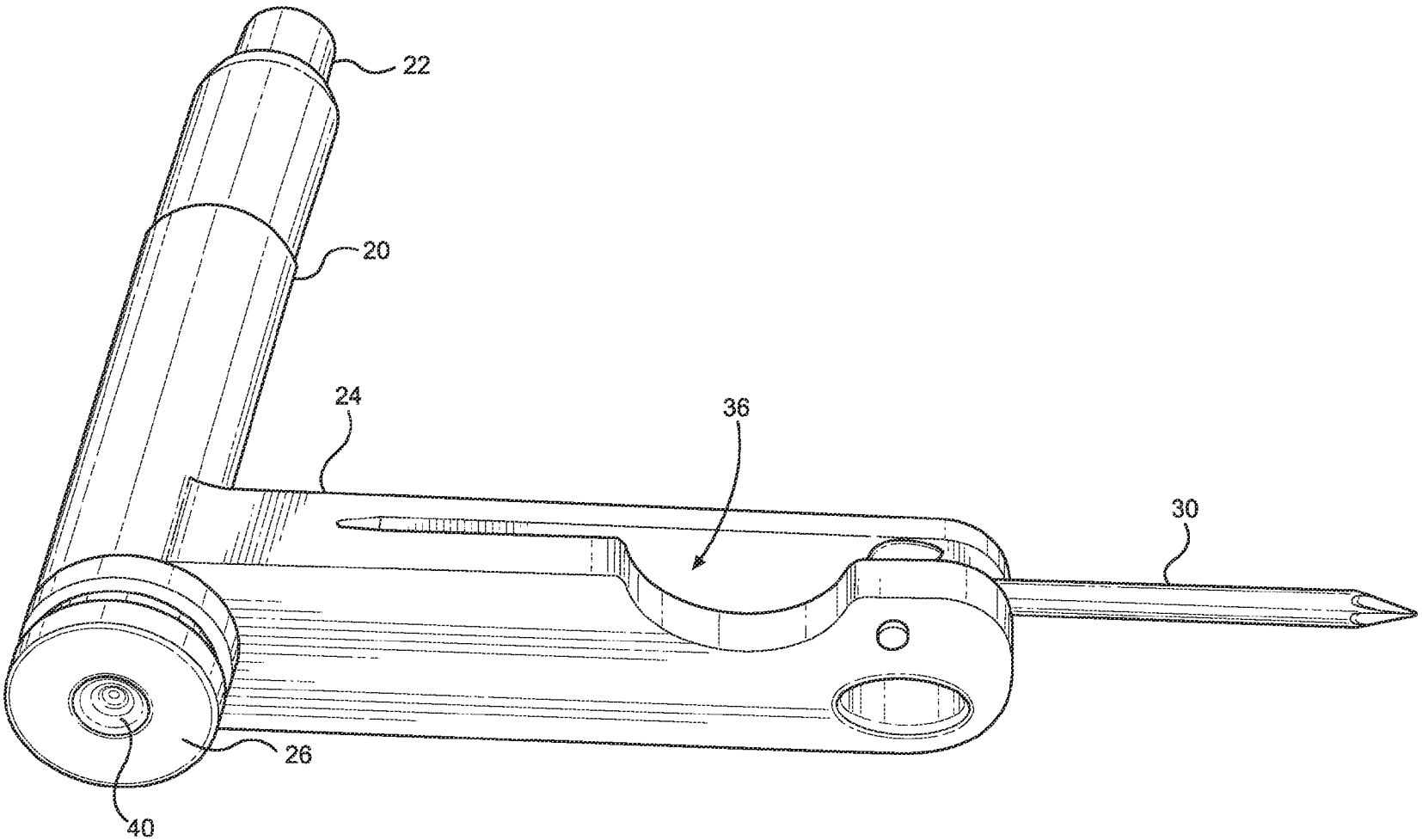
Figure 4:
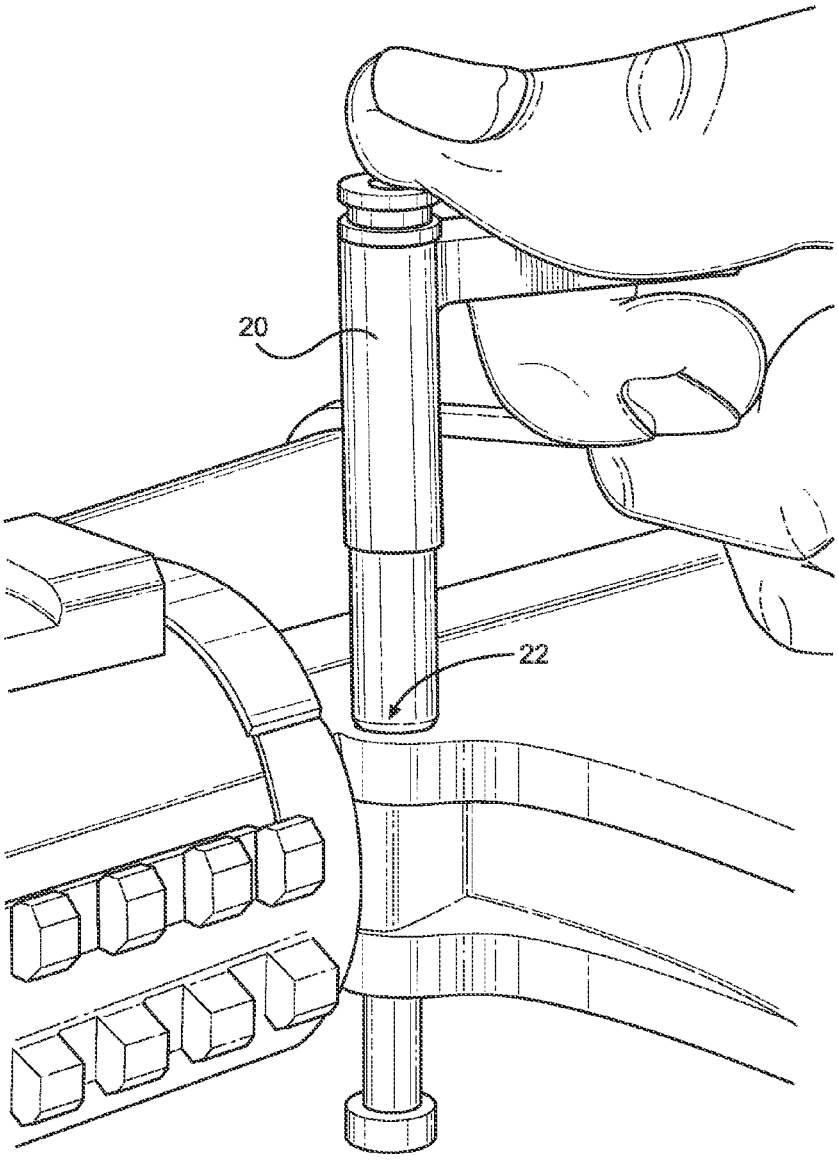
FIGS. 4-12 show the safety round of FIGS. 1-3 being used to maintain or otherwise work on a firearm.
Figure 5:
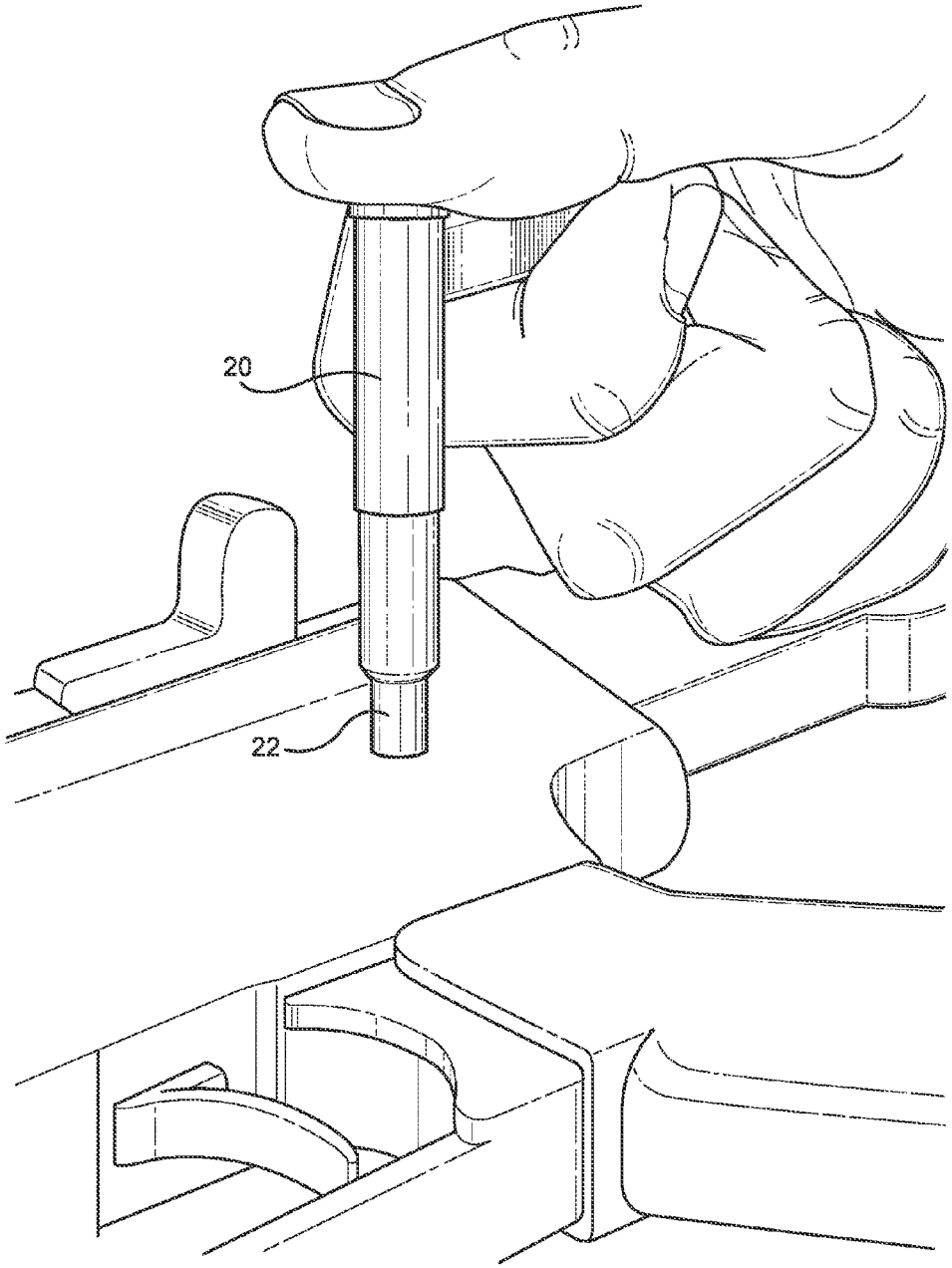
Figure 6:
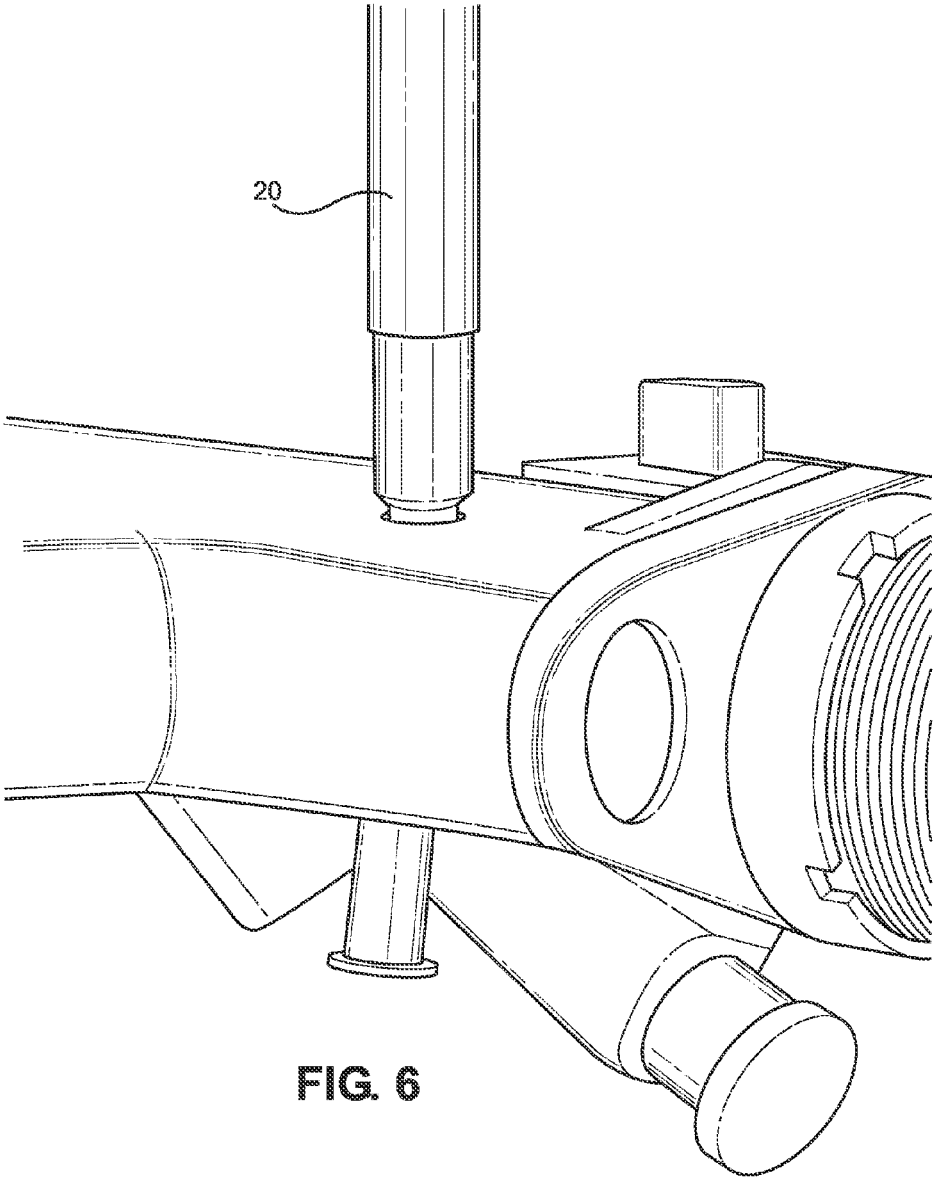
Figure 7:
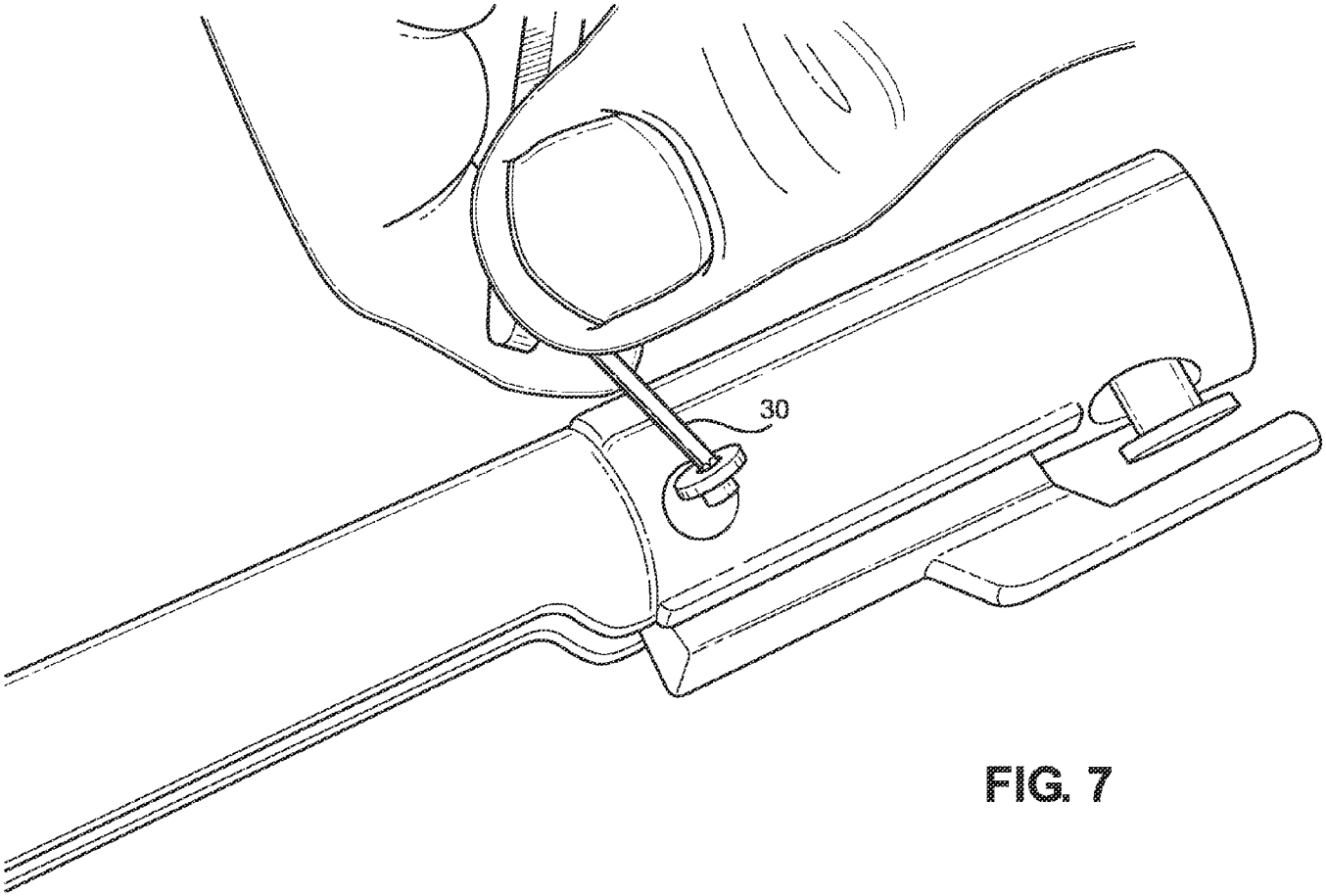
Figure 8:
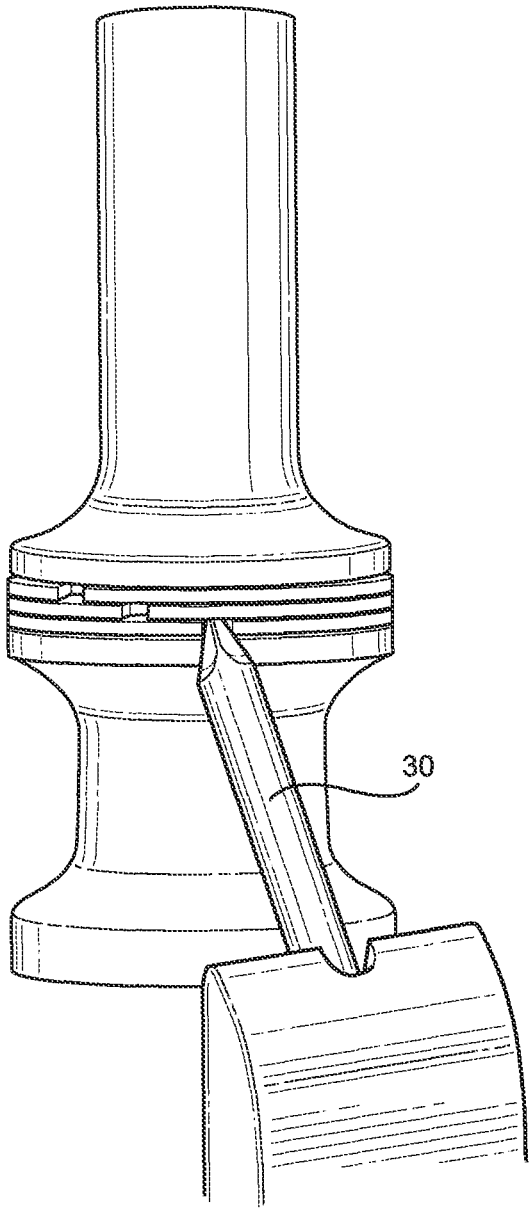
Figure 9:
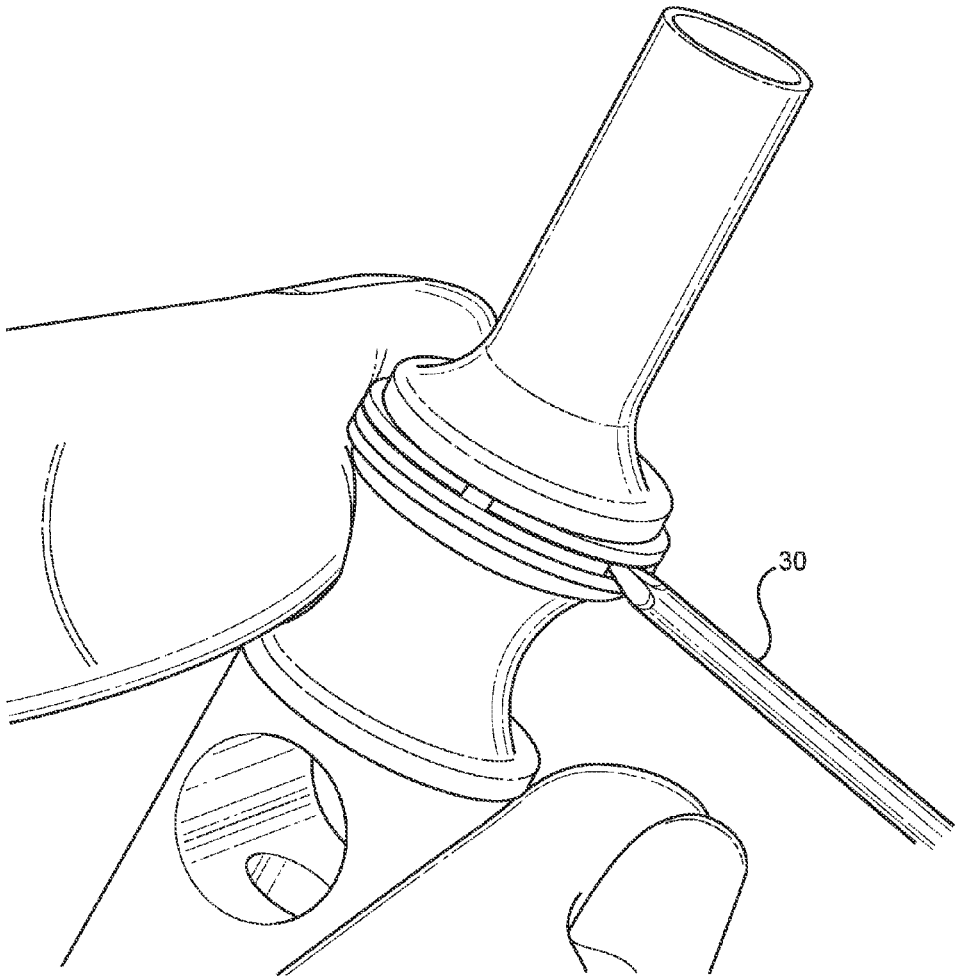
Figure 10:
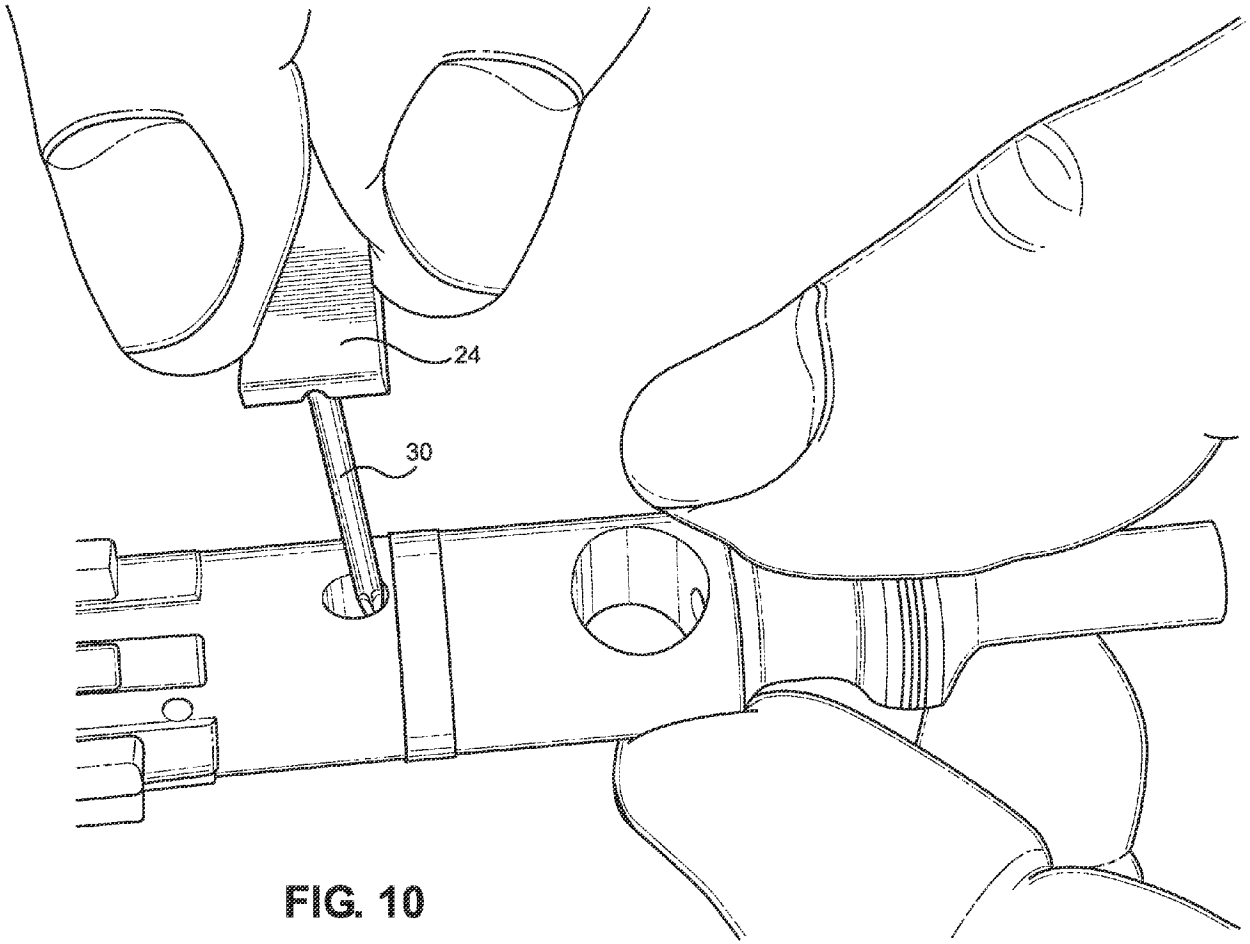
Figure 11:
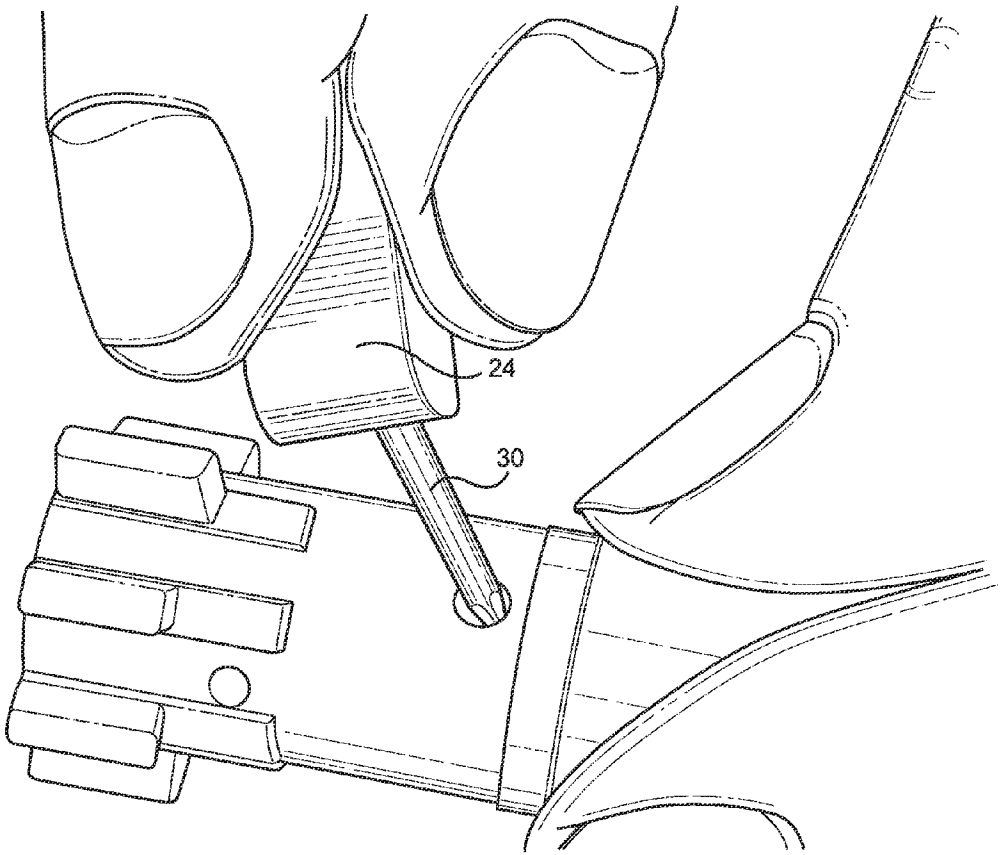
Figure 12:
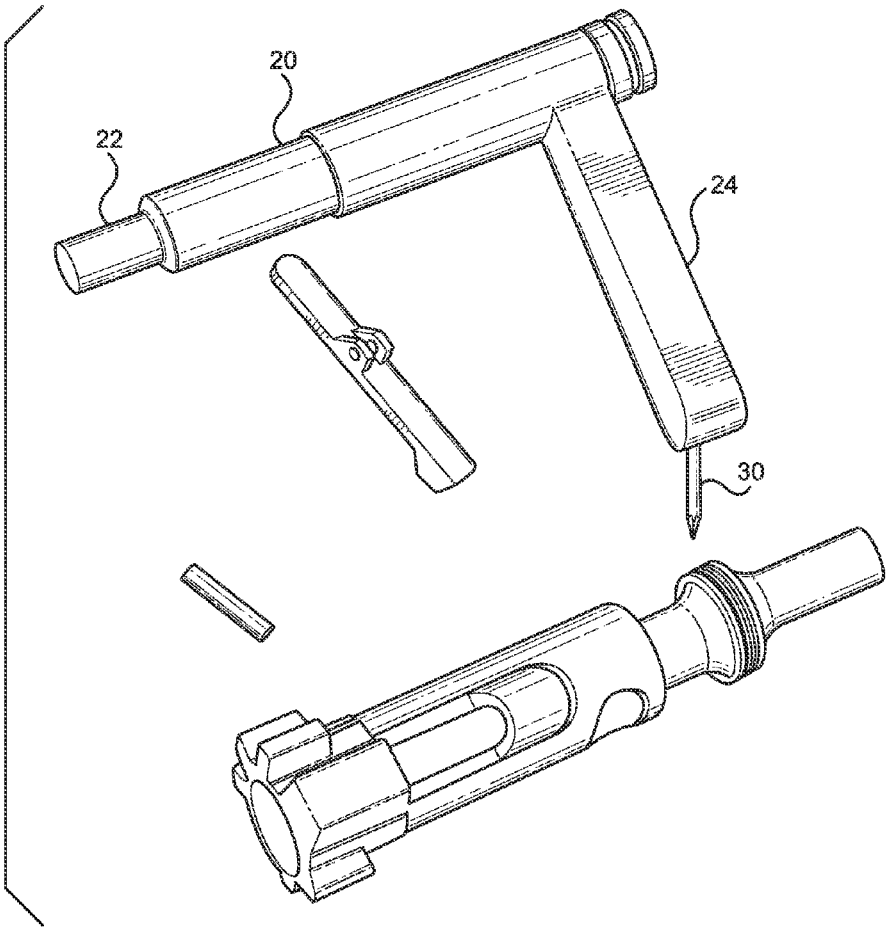

The round 10 is also configured to include a small diameter pin 30 that is useful as a tool in for field stripping and other maintenance of firearms, such as an AR-15 rifle. The tab 24 is configured to enable the pin 30 to be concealed within the tab 24 for storage, and the pin 30 is hingedly connected to the tab 24. For example, FIG. 1 shows the pin 30 concealed or otherwise positioned within the tab 24. FIGS. 2 and 3 show the pin 30 hingedly withdrawn from concealment within the tab 24.

The pin 30 may be provided as by 16 gauge stainless steel finishing nail bent at the head end opposite a point end and the bend secured around a hinge pin 32 mounted into apertures 34 defined on the tab 24. The pin 30 may also be provided as by use of metal injection techniques. A portion of the tab 24 is removed to define a channel 36 for locating the pin 30. A thumb notch 38 is provided in the side of the tab 24 for facilitating access to the pin 30.

Accordingly, in a preferred embodiment, the round 10 is also suitable to function as a tool for use with a rifle, such as an AR-15-style rifle, for removing a firing pin retaining pin, for removing an extractor retaining pin, as a gas ring spacer tool, as a push tool for removing receiver pins, as a front sight tool, and for depressing a retention pin of a recoil buffer assembly of the rifle. Examples of use of the round 10 as a tool in regards to these purposes is shown in connection with FIGS. 4-12.

For the purpose of example only, the front section 22 as shown has a diameter of about 0.225 inches, a length of about 0.3 inches. The pin 30 has a diameter of about 0.0625 inches, with an unbent length of about 1.4 inches, with the portion past the bend being about 0.95 inches. The aperture 32 has a diameter of about 1/16 inches, and the hinge pin 34 has a diameter of about 0.0625 inches and a length of about 0.25 inches. However, it will be understood that the round 10 can be sized and configured to be compatible with firearms of a variety of configurations and cartridge sizes.

As will be appreciated, combination safety round and tool devices according to the disclosure provides a safety round for a firearm having tool structures incorporated into the safety round structure. The tool structures may be used in a variety of ways to maintain or otherwise work on the firearm, without detracting from the functionality of the safety round.

The foregoing description of embodiments for this invention has been presented for purposes of illustration and description. It is not intended to be exhaustive or to limit the invention to the precise form disclosed. Obvious modifications or variations are possible in light of the above teachings. The embodiments are chosen and described in an effort to provide illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A firearm safety round configured to function as a safety round for a firearm having a firing chamber that includes bore and to be received within the firing chamber in the manner of a round of ammunition positioned or chambered for firing, the safety round comprising:

a cylindrical body portion having a first portion having a diameter and configured for being chambered into the firing chamber of the firearm in the manner of a live ammunition round, and an extension extending distally from the first portion, the extension having a smaller diameter than the diameter of the first portion and having a flattened distal end, wherein the small diameter of the extension and the flattened end of the extension render the extension suitable as a tool for field stripping and maintenance of the firearm;

a tab extending outward away from the end of the body portion, the tab sized and configured for extending out from the firing chamber when the first portion of the cylindrical body portion is chambered in the firearm and to be visible outside of the firearm in order to provide visual confirmation that the firing chamber is free of live ammunition; and a pin hingedly mounted to the tab and pivotally moveable between a first position wherein a distal end of the pin extends outwardly from the tab, and a second position wherein the distal end of the pin lies closely adjacent the tab, wherein the pin is suitable for use as a tool for maintaining the firearm when pivoted to the first position.

2. The firearm safety round of claim 1, wherein the tab includes a channel defined in a portion of the tab that is configured to receive and conceal at least the distal end of the pin when the pin is in the second position.

* * * * *